US010827807B2

(12) United States Patent
Li et al.

(10) Patent No.: US 10,827,807 B2
(45) Date of Patent: Nov. 10, 2020

(54) WATCHBAND CONNECTING PIECE, WATCHBAND, AND WATCH

(71) Applicant: Huawei Technologies Co., Ltd., Shenzhen (CN)

(72) Inventors: Junhui Li, Shenzhen (CN); Rongguang Yang, Shenzhen (CN); Menglong Zhao, Shenzhen (CN); Bin Zhang, Shenzhen (CN)

(73) Assignee: HUAWEI TECHNOLOGIES CO., LTD., Shenzhen (CN)

( * ) Notice: Subject to any disclaimer, the term of this patent is extended or adjusted under 35 U.S.C. 154(b) by 0 days.

(21) Appl. No.: 16/331,866

(22) PCT Filed: Sep. 22, 2016

(86) PCT No.: PCT/CN2016/099688
§ 371 (c)(1),
(2) Date: Mar. 8, 2019

(87) PCT Pub. No.: WO2018/053743
PCT Pub. Date: Mar. 29, 2018

(65) Prior Publication Data

US 2019/0350319 A1 Nov. 21, 2019

(51) Int. Cl.
*A44C 5/14* (2006.01)
*G04B 37/14* (2006.01)

(52) U.S. Cl.
CPC ..... *A44C 5/145* (2013.01); *G04B 37/1486* (2013.01)

(58) Field of Classification Search
CPC ..... A44C 5/145; A44C 5/2023; A44C 5/14; G04B 37/1486; G04B 37/16
(Continued)

(56) References Cited

U.S. PATENT DOCUMENTS 1,654,344 A 12/1927 Myrberg
2,163,220 A * 6/1939 Schmitz ..... G04B 37/1486 224/172
(Continued)

FOREIGN PATENT DOCUMENTS

CN 2130887 Y 4/1993
CN 2251911 Y 4/1997
(Continued)

OTHER PUBLICATIONS

Machine Translation and Abstract of Chinese Publication No. CN2130887, Apr. 28, 1993, 7 pages.
(Continued)

*Primary Examiner* — Scott T McNurlen
(74) *Attorney, Agent, or Firm* — Conley Rose, P.C.

(57) ABSTRACT

A watchband connecting piece including a body and a sliding button. A sliding slot and a buckling slot are disposed on the body, where elastic positioning pieces are disposed on the sliding button, and the elastic positioning pieces elastically protrude from a surface of the sliding button. The sliding button extends from the opening and is clamped with the buckling slot to form locking space, and the elastic positioning pieces are limited to a first position of a slot bottom wall of the sliding slot. The sliding button is unlocked from the buckling slot, and the elastic positioning pieces are limited to a second position of the slot bottom wall of the sliding slot.

20 Claims, 6 Drawing Sheets

(58) Field of Classification Search
USPC ..... 224/164, 168, 175, 179, 180; 24/265 B, 24/265 WS; 368/281–283
See application file for complete search history.

(56) References Cited

U.S. PATENT DOCUMENTS

| | | | | | |
|---|---|---|---|---|---|
| 2,876,521 | A * | 3/1959 | Legman | A44C 5/145 | 24/265 WS |
| 4,626,107 | A * | 12/1986 | Nishikawa | G04B 37/1486 | 368/276 |
| 5,218,577 | A * | 6/1993 | Seager | A44C 5/0007 | 224/165 |
| 8,418,325 | B2 * | 4/2013 | Lemosquet | A44C 5/2042 | 24/265 WS |
| 9,498,029 | B2 * | 11/2016 | Schooley | A44C 5/2057 | |
| 2004/0233795 | A1 * | 11/2004 | Fujii | G04B 37/082 | 368/285 |
| 2007/0189127 | A1 * | 8/2007 | Pollak | G04B 37/1486 | 368/294 |
| 2016/0143403 | A1 * | 5/2016 | Pluemer | A44C 5/00 | 224/267 |
| 2016/0262504 | A1 | 9/2016 | Schooley et al. | | |
| 2018/0103729 | A1 * | 4/2018 | Kim | A44C 5/105 | |

FOREIGN PATENT DOCUMENTS

| | | | |
|---|---|---|---|
| CN | 103027448 | A | 4/2013 |
| CN | 204812406 | U | 12/2015 |
| EP | 0444238 | A1 | 9/1991 |
| EP | 1995651 | A2 | 11/2008 |
| EP | 2319349 | A1 | 5/2011 |
| JP | 2006034654 | A | 2/2006 |
| WO | 2014184649 | A1 | 11/2014 |
| WO | 2015199610 | A1 | 12/2015 |

OTHER PUBLICATIONS

Machine Translation and Abstract of Chinese Publication No. CN2251911, Apr. 16, 1997, 5 pages.
Machine Translation and Abstract of Chinese Publication No. CN103027448, Apr. 10, 2013, 9 pages.
Machine Translation and Abstract of Chinese Publication No. CN204812406, Dec. 2, 2015, 10 pages.
Machine Translation and Abstract of European Publication No. EP0444238, Sep. 4, 1991, 9 pages.
Machine Translation and Abstract of European Publication No. EP1995651, Nov. 26, 2008, 13 pages.
Machine Translation and Abstract of European Publication No. EP2319349, May 11, 2011, 14 pages.
Machine Translation and Abstract of Japanese Publication No. JP2006034654, Feb. 9, 2006, 24 pages.
Foreign Communication From A Counterpart Application, Chinese Application No. 201680056726.4, Chinese Office Action dated Dec. 27, 2018, 5 pages.
Foreign Communication From A Counterpart Application, Chinese Application No. 201680056726.4, Chinese Office Action dated May 13, 2019, 7 pages.
Foreign Communication From A Counterpart Application, European Application No. 16916482.9, Extended European Search Report dated May 10, 2019, 9 pages.
Foreign Communication From A Counterpart Application, PCT Application No. PCT/CN2016/099688, English Translation of International Search Report dated Jun. 27, 2017, 2 pages.
Foreign Communication From A Counterpart Application, PCT Application No. PCT/CN2016/099688, English Translation of Written Opinion dated Jun. 27, 2017, 3 pages.

* cited by examiner

WATCHBAND CONNECTING PIECE, WATCHBAND, AND WATCH

CROSS-REFERENCE TO RELATED APPLICATIONS

This application is a U.S. National Stage of International Patent Application No. PCT/CN2016/099688 filed on Sep. 22, 2016, which is hereby incorporated by reference in its entirety.

TECHNICAL FIELD

The present invention relates to the field of watch accessory technologies, and in particular, to a watchband connecting piece, a watchband, and a watch.

BACKGROUND

A watch is a daily commodity, and may also be used as an ornament, for example, a watch with a color watchband. Most of existing watchbands are fixedly connected to watch dials. Generally, a watchband or a watch chain is connected to a watchcase by using notched tubes and pins, an elastic needle, a card issuer, a spring bar, and the like. However, all these structures need to be installed/detached by using special tools, and many of them need to be detached by professional personnel. This makes watchband replacement more difficult.

SUMMARY

Embodiments of the present invention provide a watchband connecting piece and a watchband, to implement easy detachment of the watchband.

The present invention further provides a watch.

According to a first aspect, a watchband connecting piece is provided. The watchband connecting piece is configured to connect a watchband to a watch and includes a body and a sliding button, a sliding slot and a buckling slot are disposed on the body, elastic positioning pieces are disposed on the sliding button, and the elastic positioning pieces elastically protrude from a surface of the sliding button;

the buckling slot is disposed at one end of the body, the sliding slot is located between the buckling slot and the connecting part, one side of the sliding slot is an opening, and the opening faces the buckling slot; and the sliding button is installed into the sliding slot through sliding, and an elastic force direction of the elastic positioning pieces is perpendicular to a sliding direction of the sliding button; the sliding button extends from the opening and is clamped with the buckling slot to form locking space, and the elastic positioning pieces are limited to a first position of a slot bottom wall of the sliding slot, and the sliding button is unlocked from the buckling slot, and the elastic positioning pieces are limited to a second position of the slot bottom wall of the sliding slot.

In a first possible implementation of the first aspect, a clamping tongue is extended from one side of the sliding button, a clamping slot is disposed on a slot wall that is of the buckling slot and that faces the opening, and the clamping tongue is clamped with the clamping slot to form the locking space with the buckling slot.

In a second possible implementation of the first aspect, both the first position and the second position of the sliding slot are concave parts, the elastic positioning pieces each include a spring and a spring bead located at one end of the spring, the spring and the spring bead can be installed into the sliding button through extension and contraction, and the spring ball is clamped with or unlocked from the concave parts with extension and contraction of the spring.

In a third possible implementation of the first aspect, both the first position and the second position of the sliding slot are concave parts, the elastic positioning pieces each include a tube, a spring, and a spring bead connected to one end of the spring, the spring is accommodated into the tube, the spring bead partially protrudes from the tube, and the spring bead is clamped with or unlocked from the concave parts with extension and contraction of the spring inside the tube.

With reference to the second or the third possible implementation of the first aspect, in a fourth possible implementation, the sliding slot includes slot sidewalls on two sides of the opening, sliding slots are disposed on the two slot sidewalls, limiting blocks are disposed on two ends of the sliding button, and limiting blocks are connected to the sliding slots through sliding.

With reference to the fourth possible implementation, in a fifth possible implementation, a button body is disposed on a surface that is of the sliding button and that is opposite to the elastic positioning pieces.

With reference to the second or the third possible implementation of the first aspect, in a sixth possible implementation, installation slots are disposed on the surface of the sliding button, the elastic positioning pieces are installed into the installation slots, and the spring beads protrude from the surface and can be rolled.

In a seventh possible implementation of the first aspect, the watchband connecting piece includes the connecting part, the connecting part is located at the other end that is of the body and that is opposite to the buckling slot, the connecting part includes a bearing plate and a connecting position, and the connecting position is a clamping position formed by the bearing plate and an outer contour of the sliding slot of the body, or is holes on the bearer.

According to a second aspect, a watchband is provided. The watchband includes a connecting end and the watchband connecting piece according to any one of the foregoing possible implementations, and the connecting end of the watchband is detachably installed onto the connecting part.

In a first possible implementation of the second aspect, a material of the watchband is genius leather, cloth, plastic, or metal that is the same as a material of the watchband connecting piece.

According to a third aspect, a watch is provided. The watch includes a watch body on which a connecting shaft is disposed and the watchband according to either of the foregoing implementations, and the buckling slot is clamped with the connecting shaft and is locked with the buckling slot by using the sliding button, to detachably install the watchband onto the watch body.

The watchband connecting piece described in this application is configured to fix a watchband or a watch chain without any tool, and the watchband can be conveniently installed onto a watch or detached from the watch only by gently moving the sliding button 20 by hand. This greatly improves convenience when a user installs/detaches the watchband. In addition, the watchband connecting piece can be used for a steel, soft-plastic, or genuine-leather watchband or watch chain, and therefore is widely applied.

BRIEF DESCRIPTION OF DRAWINGS

To describe the technical solutions in the embodiments of the present invention more clearly, the following briefly describes the accompanying drawings required for describing the embodiments. Apparently, the accompanying drawings in the following description show merely some embodiments of the present invention, and a person of ordinary skill in the art may still derive other drawings from these accompanying drawings without creative efforts.

DESCRIPTION OF EMBODIMENTS

The following clearly describes the technical solutions in the implementations of the present invention with reference to the accompanying drawings in the implementations of the present invention.

Figure 1:
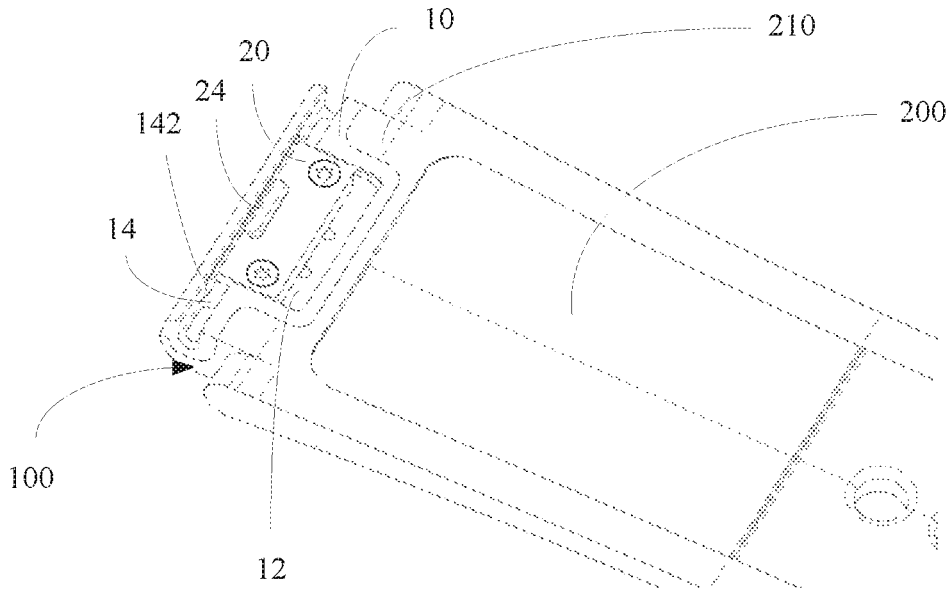
FIG. 1 is a schematic structural diagram of a watchband according to the present invention.
Figure 2:
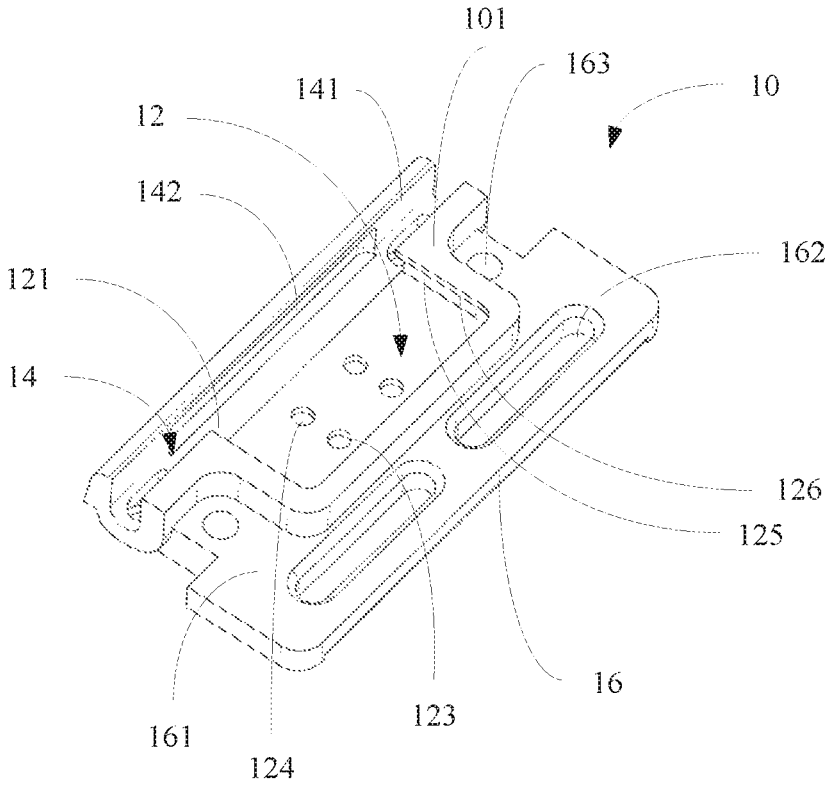
FIG. 2 is a schematic structural diagram of a body of a watchband connecting piece according to the present invention.
Figure 3:
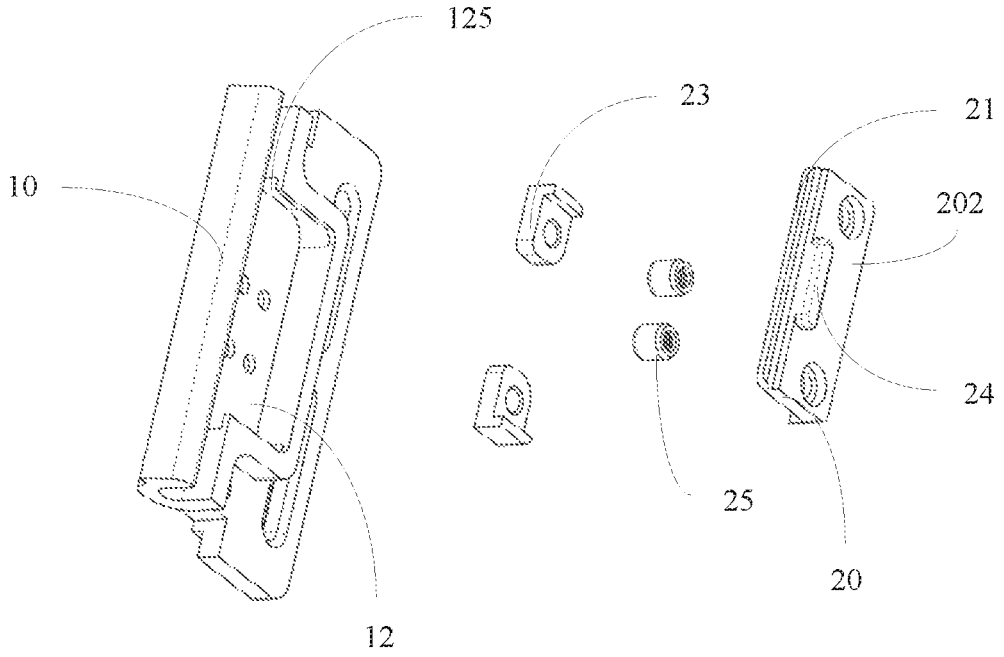
FIG. 3 is a schematic structural breakdown diagram of a watchband connecting piece according to the present invention.

Referring to FIG. 1 to FIG. 3, the present invention provides a watchband connecting piece 100, configured to connect a watchband 200 to a watch. The watchband connecting piece 100 includes a body 10 and a sliding button 20. A sliding slot 12, a buckling slot 14, and a connecting part 16 are disposed on the body 10, and elastic positioning pieces 25 are disposed on a surface of the sliding button 20. The buckling slot 14 is disposed at one end of the body 10, and the connecting part 16 is located at the other end that is of the body 10 and that is opposite to the buckling slot 14. The sliding slot 12 is located between the buckling slot 14 and the connecting part 16, one side of the sliding slot 12 is an opening 121, and the opening 121 faces the buckling slot 14.

The sliding button 20 is installed into the sliding slot 12 through sliding. The elastic positioning pieces 25 face a slot bottom wall 122 of the sliding slot 12, and an elastic force direction of the elastic positioning pieces 25 is perpendicular to a sliding direction of the sliding button 20. The sliding button 20 extends from the opening 121 and is clamped with the buckling slot 14 to form locking space, and the elastic positioning pieces 25 are limited to a first position 123 of the slot bottom wall 122 of the sliding slot 12. The sliding button 20 is unlocked from the buckling slot 14, and the elastic positioning pieces 25 are limited to a second position 124 of the slot bottom wall 122 of the sliding slot 12.

Referring to FIG. 2, specifically, the body 10 is approximately a rectangular plate body, and is made of a metal material such as stainless steel. The body 10 includes a surface 101. The strip-shaped buckling slot 14 is formed along a length direction on one side of the surface 101. The sliding slot 12 is a rectangular slot and is disposed closely adjacent to the buckling slot 14. The opening 121 of the sliding slot 12 faces the buckling slot 14, to implement penetration between the buckling slot 14 and the sliding slot 12. In this embodiment, both the first position 123 and the second position 124 of the sliding slot 12 are concave parts, and are specifically round holes. The first position 123 formed by two round holes is near the opening 121 on the slot bottom wall 122 of the sliding slot 12, and the second position 124 formed by round holes is adjacent to the first position 123, It may be understood that the first position 123 and the second position 124 may be strip-shaped arc-surface grooves.

The connecting part 16 includes a bearing plate 161 and a connecting position. The connecting position is a clamping position formed by the bearing plate 161 and an outer contour of the sliding slot 12 of the body 10, or is holes 163 on the bearer 161. Specifically, the bearing plate 161 of the connecting part 16 is formed by cutting a part towards the inside of the body 10 based on the surface 101. The bearing plate 161 is located at the edge of the sliding slot 12, and installation holes 162 are disposed on two sides of the sliding slot 12. The outer contour (clamping position) of the sliding slot 12 and the installation holes 162 are used to fix a metal watchband. The holes 163 are disposed on an edge of the connecting part 16, and holes may also be disposed on a slot bottom wall of the buckling slot 14. The holes are used to fix a non-metal watchband such as a leather watchband. Therefore, the watchband connecting piece can be suitable for different materials and different styles of watchbands, thereby improving universality of the watchband connecting piece.

Figure 4:
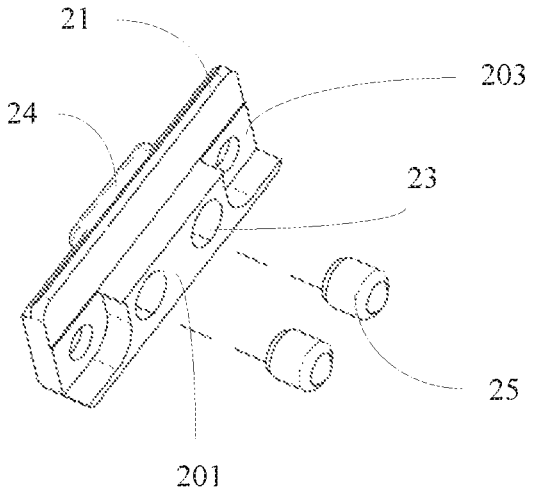
FIG. 4 is a schematic breakdown diagram of a sliding button shown in FIG. 3.

Referring to FIG. 4 together, further, a clamping tongue 21 is extended from one side of the sliding button 20, a clamping slot 142 is disposed on a slot wall 141 that is of the buckling slot 14 and that faces the opening 121, and the clamping tongue 21 is clamped with the clamping slot 142 to form the locking space with the buckling slot 14, to lock a connecting shaft that is connected to the watchband on the watch.

Figure 6:
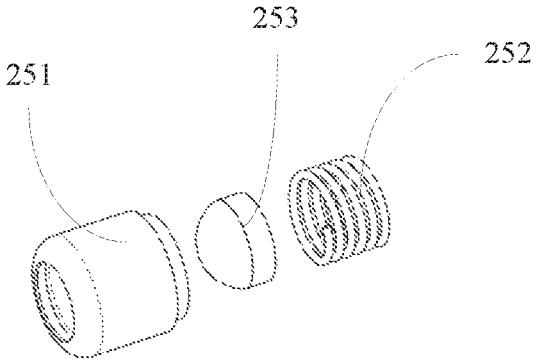
FIG. 6 is a schematic breakdown diagram of an electric connecting piece of a sliding button shown in FIG. 5.
Figure 7:
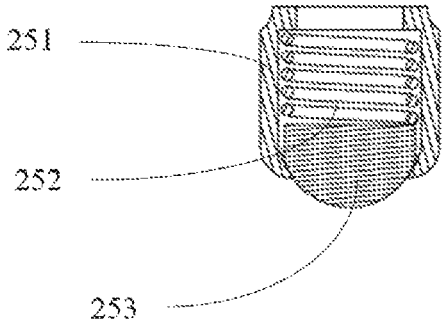
FIG. 7 is a cross sectional schematic view of an electric connecting piece of a sliding button shown in FIG. 6.

Referring to FIG. 3, FIG. 6, and FIG. 7, in this embodiment, the elastic positioning pieces 25 each include a tube 251, a spring 252, and a spring bead 253 connected to one end of the spring 252. The spring 252 is accommodated inside the tube 251, the spring bead 253 partially protrudes from the tube 251, and the spring bead 253 is clamped with or unlocked from the first position 123 and the second position 124 with extension and contraction of the spring 252 inside the tube 251. Specifically, there are two elastic positioning pieces. When the clamping tongue 21 of the sliding button 20 is unlocked from the clamping slot 142, the spring bead 253 slides to the second position 124 with the sliding button 20. When the clamping tongue 21 is locked with the clamping slot 142, the spring bead 253 slides to the first position 123 with the sliding button 20.

In another embodiment, the elastic positioning pieces each include a spring and a ball located at one end of the spring, the spring and the ball can be installed into the sliding button through extension and contraction, and the ball is clamped with or unlocked from the concave parts with extension and contraction of the spring. In another embodiment, the elastic positioning pieces 25 each may be a spring plate fixed to the surface of the sliding button 20, and a protruded part is disposed on the spring plate. When the sliding button is slid, the protruded part slides along the slot bottom wall, and the spring plate is compressed and slides to the first position or the second position, so that the protruded part is clamped with the first position or the second position.

Figure 5:
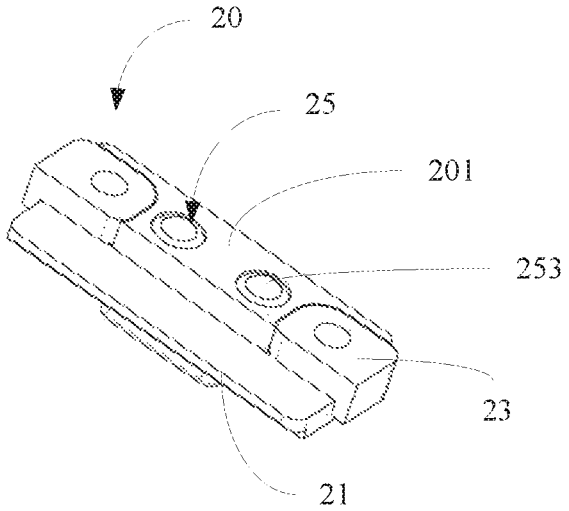
FIG. 5 is a schematic diagram of another view of a sliding button shown in FIG. 3.

As shown in FIG. 4 and FIG. 5, specifically, the sliding button 20 is a rectangular plate body, and includes a first surface 201 and a second surface 202. Installation slots 23 are disposed in a middle part of the first surface 201, the tubes 251 of the elastic positioning pieces 25 are installed into the installation slots 23, and the spring beads 253 protrude from the first surface 201 and can be rolled. Concave parts 203 are disposed on two ends of the first surface 201. A button body 24 is disposed on a surface that is of the sliding button 20 and that is opposite to the elastic positioning pieces 25. In other words, the button body 24 is disposed on the second surface 201 through protrusion, and is used to move the sliding button 20 to slide. The clamping tongue is disposed on one side of the sliding button 20 through protrusion.

Referring to FIG. 2 again, further, the sliding slot 12 includes slot sidewalls 126 on two sides of the opening 121, sliding slots 125 are disposed on the two slot sidewalls 126, limiting blocks 23 are disposed on two ends of the sliding button 20, the limiting blocks 23 are connected to the sliding slots 125 through sliding, the sliding slots 125 restricts the limiting blocks to the sliding slot 12, to restrict the sliding button 20 to the sliding slot 12. The limiting blocks 23 are approximately L-type block bodies. Parts of the limiting blocks 23 are fixed to the concave parts 203 by using screws, and the other parts of the limiting blocks 23 protrude from the two ends of the sliding button 20, to implement restriction with the sliding slots.

Figure 8:
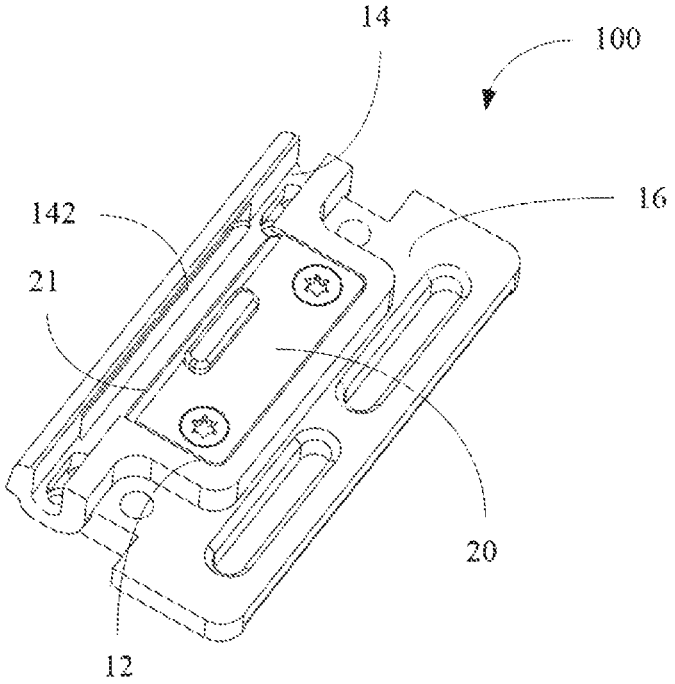
FIG. 8 and FIG. 9 are schematic diagrams of two different states of a watchband connecting piece according to the present invention.
Figure 9:
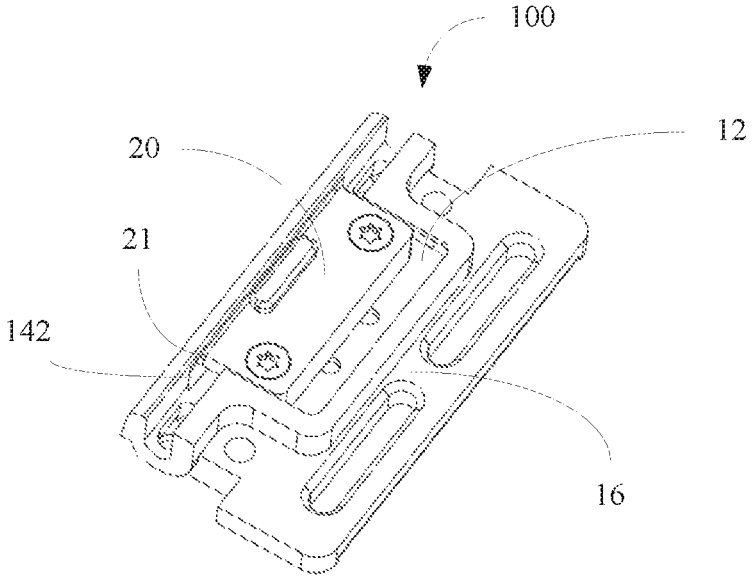

Referring to FIG. 8 and FIG. 9, the sliding button 20 is installed onto the body 10. The tubes 251 of the two elastic restriction pieces 25 are first installed onto the sliding button 20 through over pressurization; then, the limiting blocks 23 are placed into the sliding slot 12 of the body 10, and the sliding button 20 onto which the elastic restriction pieces 25 are installed is placed into the sliding slot 12; and finally, the limiting blocks 23 are separately locked onto the sliding button 20 by using screws. Due to a restriction effect of the sliding slots 125 of the sliding slot 12, the limiting blocks 23 enable the entire sliding button 20 to be limited to the body 10 without sliding out of the sliding slot 12. The sliding button 20 installed into the sliding slot 12, and under an elastic force effect of the springs 252 of the elastic restriction pieces 25, when a user finger gently moves the entire sliding button 20 to slide to a locking position, namely, the first position 123, the spring beads 253 of the elastic restriction pieces 25 fall into the first position 123 (round holes), to restrict sliding of the sliding button 20, thereby keeping the sliding button 20 at the locking position with the buckling slot 14. In addition, the clamping tongue 21 of the sliding button 20 is inserted into the clamping slot 142 of the body 10, to ensure structural cooperation strength and rigidity of the entire sliding button 20 when the entire sliding button 20 is at the locking position. When the user finger gently moves the entire sliding button 20 to slide to an open position, the spring beads 253 of the elastic restriction pieces 25 slide and fall into the second position 124, to restrict the sliding button 20 to the open position.

It may be understood that, when the watchband connecting piece 100 configured to fix a watchband or a watch chain is used for a soft-plastic watchband, a genuine-leather watchband, or a steel watchband in a specific embodiment, only partial structure modification needs to be made to the connecting part 16 of the body 10 of the watchband connecting piece 100, to adapt to a manufacturing process requirement of the corresponding watchband.

The watchband connecting piece described in this application is configured to fix a watchband or a watch chain without any tool, and the watchband or the watch chain can be conveniently installed onto a watch or detached from the watch only by gently moving the sliding button 20 by hand. This greatly improves convenience when a user installs/detaches the watchband or the watch chain. In addition, the watchband connecting piece can be used for a steel, soft-plastic, or genuine-leather watchband or watch chain, and therefore is widely applied.

As shown in FIG. 1, the present invention further provides the watchband 200. The watchband 200 includes a connecting end 210 and the watchband connecting piece 100, and the connecting end 210 of the watchband 200 is detachably installed onto the connecting part 16. A material of the watchband 200 is genius leather, cloth, plastic, or metal that is the same as a material of the watchband connecting piece.

The present invention further provides a watch. The watch includes a watch body 310 on which a connecting shaft 320 is disposed and the watchband 200. The buckling slot 14 is clamped with the connecting shaft 320 and is locked with the buckling slot 14 by using the sliding button 20, to detachably install the watchband 200 onto the watch body 310.

The foregoing descriptions are example implementations of the present invention. It should be noted that a person of ordinary skill in the art may make improvements and polishing without departing from the principle of the present invention and the improvements and polishing shall fall within the protection scope of the present invention.

What is claimed is:

1. A watchband connecting piece, wherein the watchband connecting piece is configured to connect a watchband to a watch, and wherein the watchband connecting piece comprises:

a body, wherein a sliding slot and a buckling slot are disposed on the body, wherein the buckling slot is disposed at one end of the body, wherein the sliding slot is located between the buckling slot and a connecting part, wherein one side of the sliding slot is an opening, wherein the opening is configured to face the buckling slot, and wherein the sliding slot comprises two sliding slot sidewalls on two sides of the opening;

a sliding button slidably installed into the sliding slot, wherein limiting blocks are disposed on two ends of the sliding button, wherein the limiting blocks slidably engage the sliding slot sidewalls, and wherein the limiting blocks are secured to the sliding button by screws;

elastic positioning pieces disposed on the sliding button, wherein the elastic positioning pieces elastically protrude from a first surface of the sliding button, wherein an elastic force direction of the elastic positioning pieces is perpendicular to a sliding direction of the sliding button, wherein the elastic positioning pieces are limited to a first concave position of a slot bottom wall of the sliding slot when the sliding button extends from the opening and is clamped with the buckling slot to form locking space, and wherein the elastic positioning pieces are limited to a second concave position of the slot bottom wall of the sliding slot when the sliding button is unlocked from the buckling slot.

2. The watchband connecting piece of claim 1, further comprising a clamping tongue extending from one side of the sliding button, wherein a clamping slot is disposed on a slot wall of the buckling slot that faces the opening, and wherein the clamping tongue is clamped with the clamping slot to form the locking space with the buckling slot.

3. The watchband connecting piece of claim 1, wherein each of the elastic positioning pieces comprises a spring and a spring bead located at one end of the spring, wherein the spring and the spring bead are installed into the sliding button through extension and contraction, and wherein the spring bead is clamped with or unlocked from the concave positions with extension and contraction of the spring.

4. The watchband connecting piece of claim 3, wherein the body further comprises a substantially rectangular metal plate.

5. The watchband connecting piece of claim 4, further comprising a button body disposed on a second surface of the sliding button opposite to the elastic positioning pieces.

6. The watchband connecting piece of claim 3, further comprising installation slots disposed on the first surface of the sliding button, wherein the elastic positioning pieces are installed into the installation slots, and wherein the spring beads protrude from the first surface of the sliding button and are configured to roll.

7. The watchband connecting piece of claim 1, wherein each of the elastic positioning pieces comprises a tube, a spring, and a spring bead connected to one end of the spring, wherein the spring is accommodated into the tube, wherein the spring bead partially protrudes from the tube, and wherein the spring bead is clamped with or unlocked from the concave positions with extension and contraction of the spring inside the tube.

8. The watchband connecting piece of claim 1, wherein the connecting part is located at the other end of the body and opposite to the buckling slot, wherein the connecting part comprises a bearing plate and a connecting portion, and wherein the connecting portion further comprises a clamping portion defined by the bearing plate and an outer contour of the sliding slot of the body.

9. The watchband connecting piece of claim 1, wherein the connecting part is located at the other end of the body and opposite to the buckling slot, wherein the connecting part comprises a bearing plate and a connecting portion, and wherein the connecting portion further comprises a plurality of holes on the bearing plate.

10. A watchband, comprising:

a connecting end; and a watchband connecting piece, comprising:

a body, wherein a sliding slot and a buckling slot are disposed on the body, wherein the buckling slot is disposed at one end of the body, wherein the sliding slot is located between the buckling slot and a connecting part, wherein one side of the sliding slot is an opening, wherein the opening is configured to face the buckling slot, and wherein the sliding slot comprises two sliding slot sidewalls on two sides of the opening;

a sliding button slidably installed into the sliding slot, wherein limiting blocks are disposed on two ends of the sliding button, wherein the limiting blocks slidably engage the sliding slot sidewalls, and wherein the limiting blocks are secured to the sliding button by screws; and elastic positioning pieces disposed on the sliding button, wherein the elastic positioning pieces elastically protrude from a surface of the sliding button, wherein an elastic force direction of the elastic positioning pieces is perpendicular to a sliding direction of the sliding button, wherein the elastic positioning pieces are limited to a first concave position of a slot bottom wall of the sliding slot when the sliding button extends from the opening and is clamped with the buckling slot to form locking space, wherein the elastic positioning pieces are limited to a second concave position of the slot bottom wall of the sliding slot when the sliding button is unlocked from the buckling slot, and wherein the connecting end of the watchband is detachably installed onto the connecting part.

11. The watchband of claim 10, wherein a material of the watchband is leather, and wherein the material of the watchband is the same as a material of the watchband connecting piece.

12. The watchband of claim 10, wherein a material of the watchband is cloth, and wherein the material of the watchband is the same as a material of the watchband connecting piece.

13. The watchband of claim 10, wherein a material of the watchband is plastic, and wherein the material of the watchband is the same as a material of the watchband connecting piece.

14. The watchband of claim 10, wherein a material of the watchband is metal, and wherein the material of the watchband is the same as a material of the watchband connecting piece.

15. A watch, comprising:

a watch body, wherein a connecting shaft is disposed on the watch body; and a watchband, comprising:

a connecting end; and a watchband connecting piece comprising:

a body, wherein a sliding slot and a buckling slot are disposed on the body, wherein the buckling slot is disposed at one end of the body, wherein the sliding slot is located between the buckling slot and a connecting part, wherein one side of the sliding slot is an opening, wherein the opening is configured to face the buckling slot, and wherein the sliding slot comprises two sliding slot sidewalls on two sides of the opening;

a sliding button slidably installed into the sliding slot, wherein limiting blocks are disposed on two sides of the sliding button, wherein the limiting blocks slidably engage the sliding slot sidewalls, and wherein the limiting blocks are secured to the sliding button by screws; and elastic positioning pieces disposed on the sliding button, wherein the elastic positioning pieces elastically protrude from a surface of the sliding button, wherein an elastic force direction of the elastic positioning pieces is perpendicular to a sliding direction of the sliding button, wherein the elastic positioning pieces are limited to a first concave position of a slot bottom wall of the sliding slot when the sliding button extends from the opening and is clamped with the buckling slot to form locking space, wherein the elastic positioning pieces are limited to a second concave position of the slot bottom wall of the sliding slot when the sliding button is unlocked from the buckling slot, wherein the connecting end of the watchband is detachably installed onto the connecting part, and wherein the buckling slot is clamped with the connecting shaft and is locked with the connecting shaft using the sliding button to detachably install the watchband onto the watch body.

16. The watch of claim 15, wherein a material of the watchband is leather, and wherein the material of the watchband is the same as a material of the watchband connecting piece.

17. The watch of claim 15, wherein a material of the watchband is cloth, and wherein the material of the watchband is the same as a material of the watchband connecting piece.

18. The watch of claim 15, wherein a material of the watchband is plastic, and wherein the material of the watchband is the same as a material of the watchband connecting piece.

19. The watch of claim 15, wherein a material of the watchband is metal, and wherein the material of the watchband is the same as a material of the watchband connecting piece.

20. The watch of claim 15, further comprising a clamping tongue extending from one side of the sliding button, wherein a clamping slot is disposed on a slot wall of the buckling slot that faces the opening, and wherein the clamping tongue is clamped with the clamping slot to form the locking space with the buckling slot.

* * * * *